United States Patent [19]

Saito et al.

[11] Patent Number: 4,501,402

[45] Date of Patent: Feb. 26, 1985

[54] METAL SKID FOR BUNDLING

[75] Inventors: Ken Saito, Tokyo; Tsuneo Ochi, Yokosuka; Kaoru Furunishi, Ichikawa; Takeshi Yuki, Yokohama, all of Japan

[73] Assignee: Nippon Steel Metal Products Co., Ltd., Tokyo, Japan

[21] Appl. No.: 463,502

[22] Filed: Feb. 3, 1983

[51] Int. Cl.[3] ..... B65D 19/28

[52] U.S. Cl. ..... 248/346; 108/55.3

[58] Field of Search ..... 248/346, 188.1, 188.8, 248/55.3; 108/55.3, 55.5, 56.3, 51.1, 53.1, 55.1, 57.1, 52.1, 53.5

[56] References Cited

U.S. PATENT DOCUMENTS

| | | | |
|---|---|---|---|
| 481,702 | 8/1897 | Mason | 182/222 |
| 1,690,873 | 11/1928 | O'Neil | 108/55.5 |
| 2,626,456 | 1/1953 | Harrison | 248/346 |
| 2,730,561 | 1/1956 | Cuff | 248/346 |
| 2,792,164 | 5/1957 | Cauffiel | 108/51.1 |
| 2,930,481 | 3/1960 | Bebie | 108/56.3 |
| 3,159,115 | 12/1964 | Nolan | 108/51.1 |
| 3,331,496 | 7/1967 | Marsden | 108/55.5 |
| 3,471,116 | 10/1969 | Cherrie | 248/346 |
| 3,493,128 | 2/1970 | Silvert | 108/55.5 |
| 3,567,068 | 3/1971 | Carfizzi | 108/51.1 |
| 3,677,436 | 7/1972 | Danielson | 108/55.3 |
| 4,000,704 | 1/1977 | Griffin | 108/55.3 |
| 4,305,508 | 12/1981 | Rodgers | 108/55.3 |

FOREIGN PATENT DOCUMENTS

| | | | |
|---|---|---|---|
| 2300919 | 8/1973 | Fed. Rep. of Germany | 108/51.1 |
| 1356948 | 2/1964 | France . | |

*Primary Examiner*—Reinaldo P. Machado
*Assistant Examiner*—Alvin Chin-Shue
*Attorney, Agent, or Firm*—Cushman, Darby & Cushman

[57] ABSTRACT

A metal skid for bundling is substantially shaped like a square pipe, and a series of longitudinally disposed embosses, each extending at least vertically or diagonally, are formed on each sidewall.

7 Claims, 13 Drawing Figures

METAL SKID FOR BUNDLING

This invention relates to a metal skid on which metal sheets, wooden boards, sheets and plates of other materials, coils, corrugated sheets, pipes, shapes of various sections, and so on are placed and bundled for storage in mills and plants and for transportation by trucks and vessels.

BACKGROUND OF THE INVENTION

In storing and transporting a large number of sheets and other metal products, boards of various materials, and so on, it has been a common practice to put them on square timbers placed on the floor and fasten the articles and timbers together with straps or wires for easy fork-lift haulage or truck transportation.

With the growing scarcity of timber resources, however, square steel pipes have come to be used in place of wooden skids. Yet, square steel pipes, being hollow unlike wooden skids, may collapse if they are subjected to any great impact during transportation, thereby causing the bundle to give way or making the pipe skids no longer fit for reuse. Such collapse can be prevented by using heavy-wall square pipes, but, of course, at the expense of increasing cost. When heavywall square pipes are sent to distant destinations or when only a small number of them are used, it will be difficult to recover them economically, imposing an undesirable burden on pipe skid users. Heavy load can be supported also by light-wall square pipes, if only their number per bundle is large enough to withstand the weight. This condition, however, makes this method costly and necessitates extra labor in skid transportation and storage, strapping and wiring.

When a pile of articles that are apt to bend, such as steel sheets and plywood boards, are put on skids placed at intervals, the middle portion of the load usually bends or hangs down under its own weight. Even on such an occasion, if the skids are wood, their upper corners contacting the bottom of the mounted articles will get rounded following the way the articles bend and thereby inflict no scratch or damage to the articles, either the soft wooden skid corners getting deformed or the articles biting into them. If the skids are square steel pipes, on the other hand, their upper corners are too hard to deform as wooden skids might do, as a consequence of which the articles in the lower part of the bundle might break or otherwise damaged under the weight of the bundle.

Other type of metal skid than square pipes is the pallet skid device disclosed in U.S. Pat. No. 3,943,860. This skid comprises a horizontal member having legs extending from opposite ends thereof, with the horizontal member and legs each having a channel-like cross section for the purpose of reinforcement. For this type of skid having legs, it is difficult to support a heavy load because the legs are liable to break at their joint with the skid proper. The need to adjust the inter-leg space of each skid to the size of each individual article requires long manufacturing time and makes the skid costly.

U.S. Pat. No. 2,626,456 discloses a palletizing skid made of an ingot. The ingot has at its bottom a longitudinal channel, a deeper notch perpendicularly intersecting the channel, and a series of serrations. Although this skid is suited for supporting a heavy bundle, the great weight of the skid itself often causes inconvenience in handling.

U.S. Pat. No. 2,716,532 discloses a disposable skid made of flat sheet-like material such as fiber board. Although light in weight and convenient for handling, this skid is unsuited for supporting a heavy bundle.

SUMMARY OF THE INVENTION

This invention has been made to solve the aforementioned problems with the conventional skids for bundling.

An object of this invention is to provide a metal skid for bundling that is light in weight, high in strength, and low in cost.

Another object of this invention is to provide a metal skid for bundling that is easy to handle, transport and store.

Still another object of this invention is to provide a metal skid for bundling on which even a bendable article does not get scratched or otherwise damaged by the corner of the skid.

Yet another object of this invention is to provide a metal skid assembly for bundling that is light in weight, high in strength, and low in cost.

A metal skid for bundling according to this invention comprises a square pipe made of metal sheet which has a number of embosses or embossments, each extending vertically, diagonally, or otherwise, longitudinally formed on both side walls.

Thanks to the embosses on both side walls, the skid of this invention is able to support a large vertical load. It is because of this that the skid can be made of thin steel sheet, which, in turn, makes it possible to reduce the weight of the skid.

Also, the long embossed square pipe according to this invention can be cut to a desired length according to the size of articles to be bundled thereon. This flexibility allows the manufacture of low-cost skids with ease.

Furthermore, the top of the skid of this invention, which comes in contact with the articles placed thereon, is arched upward. When the articles are placed on the skid, the arched top undergoes elastic deformation. This elastic deformation prevents the articles from being scratched or otherwise damaged, alleviates stress concentration, and helps increasing skid strength.

DETAILED DESCRIPTION OF THE PREFERRED EMBODIMENTS

Figure 1:
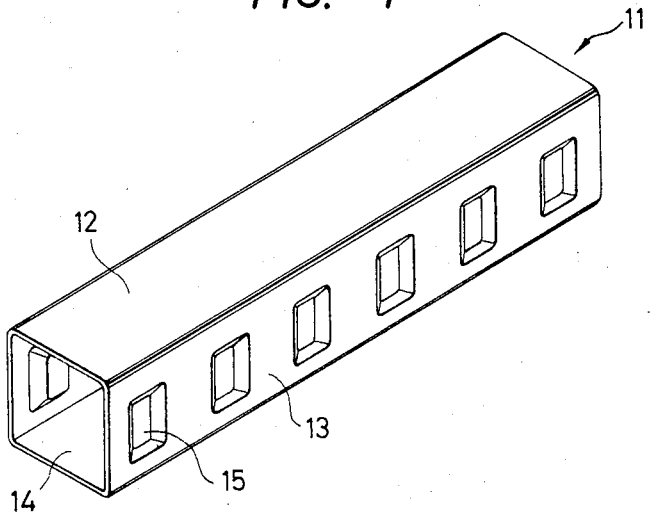
FIG. 1 is a perspective view of skid embodying the principle of this invention.

As shown in FIG. 1, a skid 11 is a square pipe consisting of a top 12 extending horizontally, side walls 13 perpendicularly extending downward from both sides of the top 12, and a bottom 14 extending parallel to the top 12. On each sidewall 13 are longitudinally formed a series of vertically long rectangular embosses 15 each projecting inward. For the purpose of increasing the collapse strength of the skid 11, it is preferable to make the emboss 15 to extend at least vertically or diagonally to cover the greatest possible portion of the sidewall height allowed by the fabrication technique employed.

The skid 11 is made of a long metal sheet such as a steel sheet having a thickness of approximately 1 mm to 4 mm. Before the steel sheet is formed into a square pipe form, the embosses 15 are formed in areas that are to form the sidewalls 13 later. Then, the sheet is bent three times, 90 degrees each time, to form the top 12, sidewalls 13 and bottom 14, and a square-pipe-like skid is completed by welding a seam between the meeting edges of the bent sheet. The skid is then cut into a suitable length according to the size of articles to be supported thereby. All these fabrication steps are accomplished on a train of pipe-making mills, whereby the high-quality skid according to this invention can be obtained at a cost that is comparable to the manufacturing cost of ordinary square pipes on conventional pipe mills.

Figure 2:
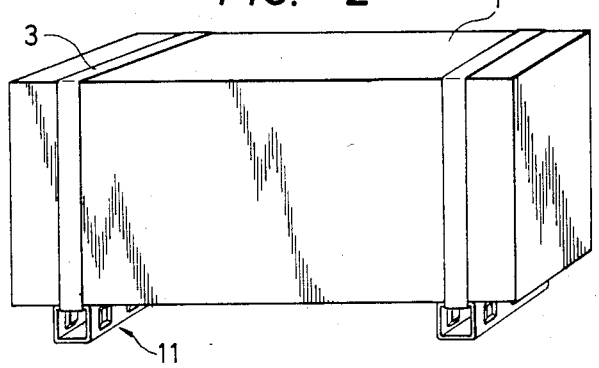
FIG. 2 is a perspective view of a bundle of articles strapped on skids according to this invention.

Depending on the size and shape of articles to be supported, more than one (FIG. 2 shows an example with two skids) steel skids thus fabricated are placed on the floor leaving an appropriate space in between. With a package 1 of articles placed on the skids, a band 3 is passed through the hollow inside of each skid 11 and over the package 1 to hold them together.

The package is either stored in plant or fork-lifted onto trucks, freight-cars or vessels for transportation in this state, so the articles and skids must be tightly fastened together. Otherwise, the package may become loose or damaged during storage and transportation.

Figure 3:
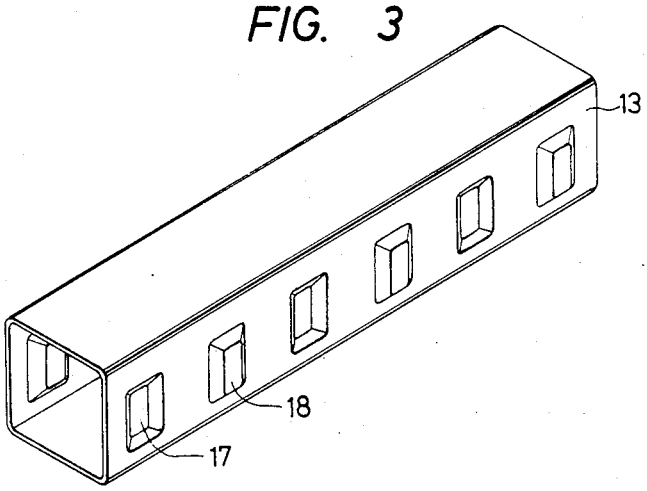
FIG. 3 is a perspective view showing another embodiment of this invention.

The shape of the emboss is not limited to the one on the preferred embodiment described above. FIG. 3 shows an example in which inwardly projecting rectangular embosses 17 and outwardly projecting rectangular embosses 18, both being vertically long, are alternately formed on each side wall 13.

Figure 4:
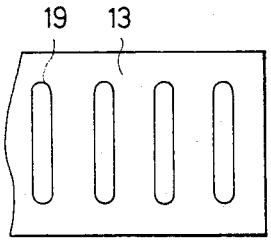
FIGS. 4 and 5 are side elevations showing a portion of the skids having embosses of different shapes.
Figure 5:
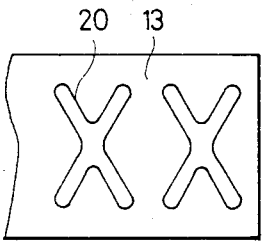

A long narrow emboss 19 shown in FIG. 4 also increases resistance against buckling. An X-shaped emboss 20, consisting of two grooves crossing at an angle of 45 to 75 degrees, shown in FIG. 5 is particularly effective in resisting a diagonal force that may work on the skid when, for example, emergency brakes are put on during transportation. The shape and intervals of embosses may be freely determined so long as they can provide adequate strength to prevent said wall buckling and plastic deformation.

Figure 6:
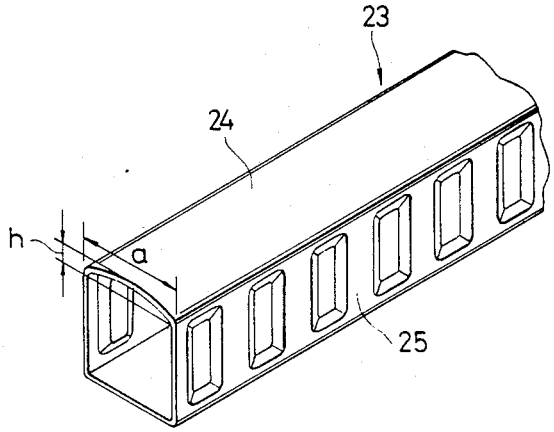
FIG. 6 is a perspective view showing still another embodiment of this invention.

FIG. 6 shows still another embodiment of this invention. The top 24 of a skid 23 is arched upward. When a heavy load like a bundle of steel sheets is placed on the skid 23, the arched top 24 supports the load while undergoing elastic deformation, thereby allowing the load to be tightly fastened to the skid 23. Even if the joint between the top 24 and a sidewall 25 is not smoothly curved but square, the load is kept out of contact with the angular corner since the load is supported by the elastically deforming arched top 24. This allows the articles to remain scratch- or damage-free. This advantage is particularly important when articles are placed on skids in a bare state.

As shown in FIG. 6, the ratio of the height of crown h to the chord a approximately ranges between 1:10 and 1:30, varying according to the size of skid. The upward bulging top 24 elastically supports the load mounted on the skid, without inducing stress concentration and, therefore, indenting or otherwise damaging the articles under pressure. If the h-to-a ratio exceeds 1:10, a contact indentation results as a result of stress concentration. When the ratio is smaller than 1:30, on the other hand, articles that are apt to warp may bend or get damaged under their own weight at the corners on both sides of the top 24.

Figure 7:
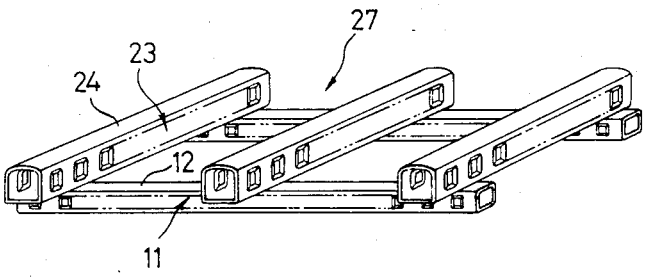
FIG. 7 is a perspective view showing a lattice-like assembly of skids according to this invention.

FIG. 7 shows a skid assembly 27 consisting of skids 11 shown in FIG. 1 and skids 23 shown in FIG. 6. In the skid assembly 27, three skids 23 are placed on and fastened to, by welding or other method, two skids 11 placed parallel to each other at a suitable interval. The top 12 of the skid 11 is flat so that the skid 23 rests securely thereon at an intersection. The bottom of the articles supported contacts the upward-arched top 24 of the skid 23 placed atop.

This skid assembly 27 is capable of supporting a heavier load than individual skids that are used in an unassembled or an unfastened form.

Figure 8:
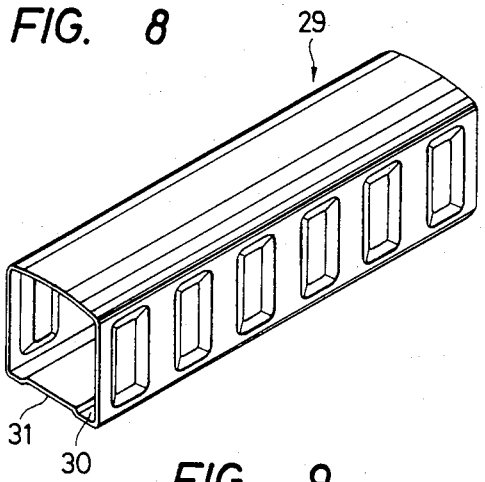
FIG. 8 is a perspective view showing yet another embodiment of this invention.

FIG. 8 shows yet another embodiment of this invention. A skid 29 in FIG. 8 is similar to the one shown in FIG. 6 except that a longitudinal, internally projecting groove 31 is formed at the bottom 30.

Figure 9:
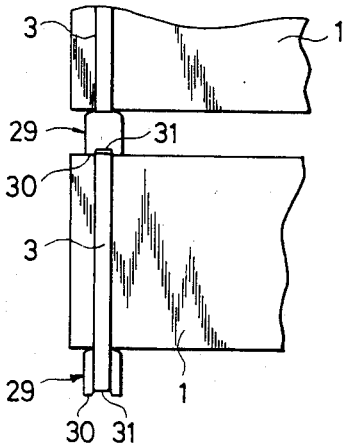
FIG. 9 shows how bundles of articles strapped together on the skids of FIG. 8 are piled up one over another.

As shown in FIG. 9, this skid 29 is particularly convenient for storing and transporting several bundles of articles piled on another. The band 3 strapping the lower bundle 1 is allowed to project upward slightly, namely, by the amount approximately equal to the thickness of the band 3. This projection prevents the flat-bottomed skid fastened to the upper bundle from slipping. With the band 3 strapping the upper bundle 1 fitting in the groove 31 of the upper skid 29, the skid 29 rests securely on the bundle 1.

Figure 10:
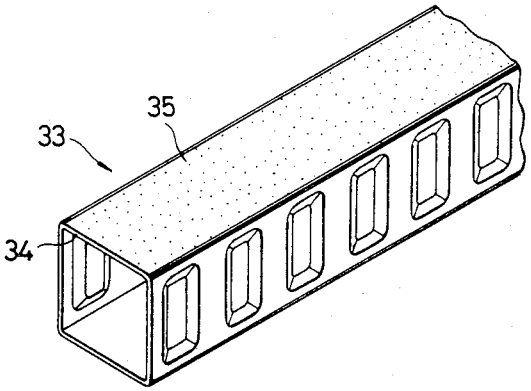
FIG. 10 is a perspective view showing a skid with a slip-proof top.

FIG. 10 shows a skid 33 that is similar to the one shown in FIG. 1 except that a slip-proof coating 35 is provided on the top surface 34 thereof. Especially when a bundle of articles is subjected to severe vibrations during transportation, the bundle is likely to get loose with the articles slipping over the skids. The skid 33 with the slip-proof coating 35 is suited for use in rough transportation. A similar slip-proof coating may be provided also on the bottom surface of a skid. Such a skid will not slip over the floor on which it is placed and, therefore, will be suited for transportation on vessels and the like.

The preferable slip-proof coating material is a mixture of an abrasive, which consists of one or more of aluminum oxide, silicon carbonate, garnet, emery and flint, and an organic adhesive of the phenol-, epoxy-, polyurethane-, melamine- or acryl-based type or an inorganic adhesive like water glass. Such a mixture is applied to the arched top of the skid either directly or indirectly by attaching a paper tape on which the mixture is spread.

Based on the results of experiments conducted by the inventor, the strength of the steel skids according to this invention will be described in the following.

Figure 11:
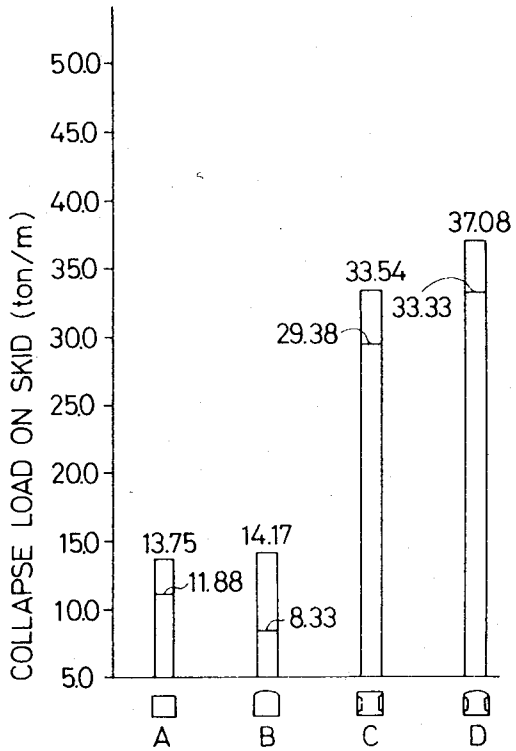
FIG. 11 graphically compares the magnitudes of loads under which the steel skids of this invention and other conventional skids collapse.

FIG. 11 compares the collapse strength of skids according to this invention with that of conventional skids. In FIG. 11, reference character A designates an ordinary square skid, B a square skid having an arched top, C a square skid with sidewalls having inwardly projecting embosses, and D a square skid with an arched top and sidewalls having inwardly projecting embosses. All skids shown in FIG. 11 are 50 mm high, 50 mm wide, and 240 mm long, made by bending 1.6 mm thick hot-rolled steel sheets conforming to JIS G 3101, SS41 (Rolled Steel for General Structure, the Japanese Industrial Standards) into square-pipe-like form. The arched crown at the top of skids B and D is 3 mm in height. On each wall of skids B and D are provided six embosses, each of which is 3 mm deep, 40 mm long and 20 mm wide.

The dimensions (except the length) of the skids are similar to those of typical skids put to practical use. FIG. 11 shows the collapse load per meter of skid length. The collapse strength of each skid was examined by uniformly applying a load on the top thereof. The test was repeated 10 times on each type of skid, and the graph shows the maximum and minimum loads under which the skid collapsed. As shown in FIG. 11, skid A collapsed under a load ranging between approximately 12 t/m and 14 t/m. Skid B with an arched top exhibited substantially the same result as skid A. Skids C and D proved to have much higher collapse strengths than skids A and B. Generally, the maximum allowable load of a skid is estimated by applying a safety factor of 2, so the maximum allowable load for the skids according to this invention becomes 15 t/m. This collapse strength is more than twice larger than that of conventional square-pipe skids.

Figure 12:
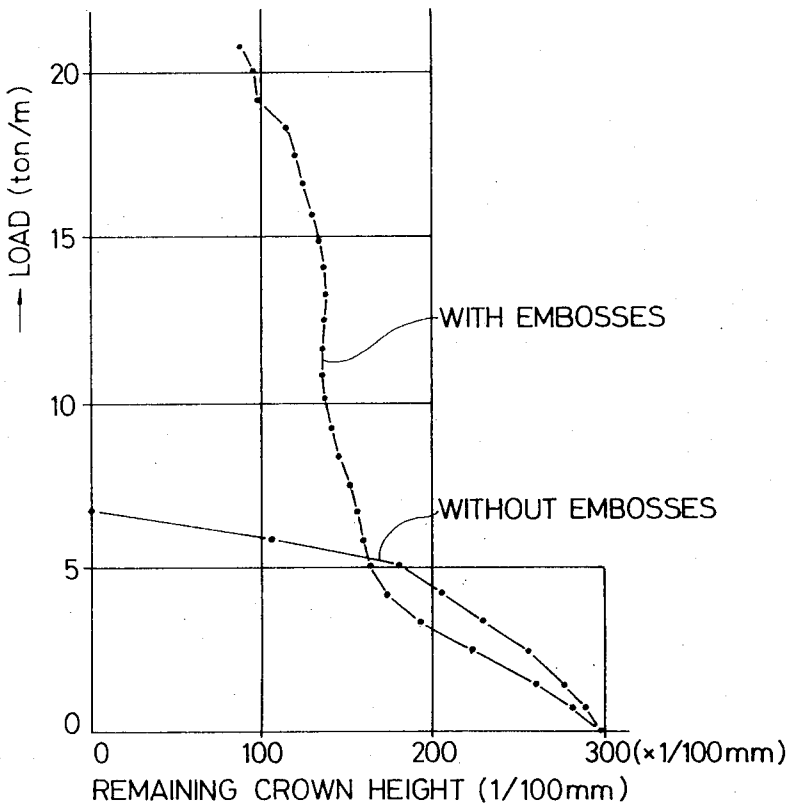
FIG. 12 graphically shows the relationship between the load working on the arched top of the steel skid of this invention and the amount of crown left unflattened under the load.

Load was applied on a skid having an arched top. FIG. 12 shows the relationship between the load applied and the height of the arched crown measured after the load had been released. FIG. 12 also shows the load per meter of skid length. The skid used was of the same dimensions as those shown in FIG. 11; 50 mm in height and width, 1.6 mm in wall thickness, 3 mm in crown height, and 3 mm in emboss depth.

As will be evident from FIG. 12, the arched top of the embossed skid remained unflattened even when the maximum allowable load of 15 t/m, calculated previously, was applied, with the crown height decreasing only to approximately half. Practically, the crown height may be allowed to decrease to approximately one-third of the original height. By contrast, the arched top of an emboss-free skid became totally flat under a much lighter load of 6.7 t/m.

Figure 13:
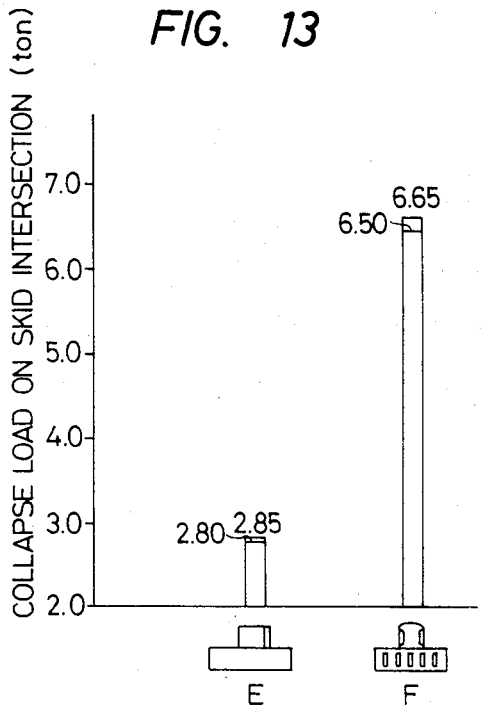
FIG. 13 graphically compares the collapse strengths at the intersecting point where two each steel skids of this invention and of conventional design cross.

The skid assembly shown in FIG. 7 is widely applicable to the bundling of sheet-formed products and the like. The maximum allowable load applicable on this skid assembly depends upon the collapse strength at the intersection where the skid 11 crosses the skid 23. FIG. 13 compares the collapse strength of conventional square-pipe skid assembly E with that of skid assembly F according to this invention. The dimensions and material of the individual skids are the same as those of the skids shown in FIG. 11. The collapse load shown is that which is applied on each intersection.

As will be evident from FIG. 13, skid assembly F according to this invention withstood a collapse load of approximately 6.6 tons, while skid assembly E of conventional design withstood a collapse load of approximately 2.8 tons. With the aforementioned safety factor of 2 in mind, the collapse load applicable on each intersection of skid E is 3.3 tons, while that on skid F is 1.4 tons. This means that the skid assembly according to this invention can withstand more than twice larger load than conventional ones. In other words, the skid assembly of this invention can be made that much lighter.

What is claimed is:

1. A metal skid for bundling adapted to be laid parallel to at least one other like skid to support a bundle of articles and to be fastened to the bundle by a strap or the like, characterized in that:

said skid is of a substantially square-pipe-like shape having a hollow interior through which a bundling strap or the like may be passed;

is made of light-weight sheet metal;

has a top wall adapted to be contacted by a bundle placed thereon;

has side walls depending from each side of said top wall; and has a bottom wall;

said top wall being smoothly-curved upwardly-arched with a center of curvature below the upper ends of said side walls;

said side walls each having a longitudinally arranged row of reinforcing embosses each extending a major portion of the height of said side walls and said row extending substantially the full length of said skid.

2. A skid according to claim 1 in which the ratio of the height to the width of the arched top wall is in the range of from about 1 to 10 to about 1 to 30.

3. A skid according to claim 1 in which the bottom wall has an inwardly projecting longitudinal groove.

4. A skid according to claim 1 in which the top wall has a coating of slip-proof material on its upper surface.

5. A skid according to claim 1 in which the bottom wall has a coating of slip-proof material on its bottom surface.

6. A skid according to claim 1 wherein the corners between the top wall and the side walls are rounded.

7. A skid assembly adapted to support a bundle of articles and to be fastened to the bundle by straps or the like, comprising;

a plurality of first and second skids;

each of said skids having a substantially square-pipe-like shape defining a hollow interior through which a bundling strap or the like may be passed;

each of said skids being made of light-weight sheet metal;

each of said skids having a top wall, the top wall of said second skids being adapted to be contacted by a bundle placed thereon;

each of said skids having side walls depending from each side of said top wall;

each of said skids having a bottom wall;

said top wall of said second skids being smoothly-curved upwardly-arched with a center of curvature below the upper ends of said side walls;

said side walls each having a longitudinally arranged row of reinforcing embosses, each extending a major portion of the height of said side walls and said row extending substantially the full length of the corresponding skid;

said first skids being disposed in spaced parallel relation; and said second skids being disposed in spaced parallel relation and over and at right angles to said first skids; and said first and second skids being fastened to each other at their crossing points.

* * * * *